US008963907B2

(12) United States Patent
Tsai et al.

(10) Patent No.: US 8,963,907 B2
(45) Date of Patent: Feb. 24, 2015

(54) PIXEL CIRCUIT AND DRIVING METHOD THEREOF

(71) Applicant: AU Optronics Corp., Hsinchu (TW)

(72) Inventors: Tsung-Ting Tsai, Hsin-Chu (TW); Yun-Hsiang Lee, Hsin-Chu (TW)

(73) Assignee: Au Optronics Corp., Hsin-Chu (TW)

( * ) Notice: Subject to any disclaimer, the term of this patent is extended or adjusted under 35 U.S.C. 154(b) by 188 days.

(21) Appl. No.: 13/677,821

(22) Filed: Nov. 15, 2012

(65) Prior Publication Data

US 2013/0127818 A1 May 23, 2013

(30) Foreign Application Priority Data

Nov. 18, 2011 (TW) ..... 100142405 A

(51) Int. Cl.

| | |
|---|---|
| ***G06F 3/038*** | (2013.01) |
| ***G09G 5/10*** | (2006.01) |
| ***G09G 3/14*** | (2006.01) |
| ***G09G 3/32*** | (2006.01) |

(52) U.S. Cl.

CPC ..... *G09G 3/14* (2013.01); *G09G 3/3233* (2013.01); *G09G 2300/0852* (2013.01); *G09G 2300/0861* (2013.01); *G09G 2300/0819* (2013.01)

USPC ..... 345/212; 345/690

(58) Field of Classification Search

CPC ..... G09G 3/14; G09G 3/32; G09G 3/3208

USPC ..... 345/76–83, 204–215

See application file for complete search history.

(56) References Cited

U.S. PATENT DOCUMENTS

| | | | | |
|---|---|---|---|---|
| 2008/0088546 | A1* | 4/2008 | Takasugi et al. | 345/76 |
| 2011/0134153 | A1* | 6/2011 | Uchino et al. | 345/690 |
| 2011/0241735 | A1 | 10/2011 | Chou | |
| 2012/0098810 | A1 | 4/2012 | Nieh et al. | |

* cited by examiner

*Primary Examiner* — Michael Pervan
*Assistant Examiner* — Andrew Lee
(74) *Attorney, Agent, or Firm* — WPAT, PC; Justin King

(57) ABSTRACT

A driving method of a pixel circuit, implemented with five transistors and two capacitors, includes steps of: supplying three control signals and a gate signal to the pixel circuit; modulating an operation state of each control signal and keeping the gate signal being disable so as to reset data of the pixel circuit and have an voltage compensation effect on the pixel circuit; and enabling the gate signal so as to operate the pixel circuit in a data writing period, and supplying, in the data writing period, a data voltage to the pixel circuit so as to change a terminal voltage of a driving transistor, which is used to drive the light-emitting device. A pixel circuit is also provided.

15 Claims, 12 Drawing Sheets

PIXEL CIRCUIT AND DRIVING METHOD THEREOF

TECHNICAL FIELD

The present disclosure relates to a pixel circuit and a driving method thereof, and more particularly to a pixel circuit, which is basically implemented by five transistors and two capacitors (5T2C), and a driving method thereof.

BACKGROUND

Based on a driving mean, Organic Light-Emitting Diode (OLED) can be categorized into Passive Matrix OLED (PMOLED) and Active Matrix OLED (AMOLED). PMOLED, due to be configured to emit light only in a data writing period, can have a simple circuit structure, a lower cost and a simple circuit design; and thus, the early display industries much focus on the development of PMOLED technology. However, the PMOLED, due to the driving mean, may have some serious problems, such as having relatively high power consumption and a relatively short life when the PMOLED is applied to large-size displays. Therefore, basically the PMOLED is only used in medium-size or small-size displays.

The AMOLED is different to the PMOLED in that each pixel has a capacitor configured to store data and thereby keeping each pixel operated in a light-emitting state. Compared with the PMOLED, the AMOLED has several advantages, such as having lower power consumption and having a driving mean which is adapted to be used in a large-size and high-resolution display. Therefore, the AMOLED today is the mainstream technology in the display field.

Even the AMOLED consumes less power and is suitable for some large-size and full-color applications in displays; the AMOLED still has some design problems. For example, when an OLED or a Thin Film Transistor (TFT) functioned as a switch or a driving component in the AMOLED has a material property variance or a material aging issue, a uniform problem may occur on the associated display. According to a number of documents and disclosures, the uniform problem can be improved by a compensation circuit; wherein the compensation circuit basically is categorized into a voltage type and a current type.

The voltage-type compensation circuit, configured to compensate the threshold voltage ($V_{TH}$) of TFTs, still has some problems, such as having a complicate circuit design and requiring a relatively large number of components therein.

In contrast, although the current-style compensation circuit can have its device characteristics without being affected by the flowing-through current, but the current, as the data input format, cannot be configured to be as accurate as the voltage source is. In addition, the current-style compensation circuit also requires more time for charging/ or discharging capacitors therein while being operated in a low grayscale.

Moreover, a pixel circuit is required to switch displays in a relatively high frequency while it uses a temporal division of 3D display; accordingly, the high frame rate may limit the compensation effect of the current-type or voltage-type compensation circuits and consequently limit the time for writing data voltages, as illustrated in FIG. 1; wherein 1H represents a period while a pixel circuit is enable (or, a horizontal scan line is turned-on). According to the existing compensation technologies, the data resetting, the $V_{TH}$ compensation and the data writing must be complete within the period 1H; thus, there will be no sufficient time for the data writing if the pixel circuit has a relatively high frame rate. However, it is understood that a display panel cannot normally write data as well as display the data without a sufficient data writing period; therefore, the frame rate of a display is limited to be higher if it has a limited data writing period.

Therefore, it is desirable to provide a pixel circuit in an AMOLED to prevent the above-mentioned problem.

SUMMARY

The disclosure provides a pixel circuit, which includes a first switch, a second switch, a third switch, a fourth switch and a driving transistor. The switches and the driving transistor each have a first terminal, a second terminal and a control terminal configured to control turn-on or turn-off between its associated first and second terminals. The first terminal of the first switch is configured to receive a data voltage. The second terminal of the first switch, the second terminal of the third switch and the control terminal of the driving transistor are configured to be electrically coupled to a first connecting node. The first terminal of the second switch is configured to receive a first power voltage. The first terminal of the fourth switch is configured to receive a second power voltage. The first terminal of the third switch is configured to receive a third power voltage. The second terminal of the fourth switch and the first terminal of the driving transistor are configured to be electrically coupled to each other. The second terminal of the second switch and the second terminal of the driving transistor are configured to be electrically coupled to each other.

The disclosure still further provides a driving method of a pixel circuit adapted to be used to drive a light-emitting device. The driving method includes steps of: supplying a plurality of control signals and a gate signal to the pixel circuit; modulating an operation state of each control signals and keeping the gate signal being disable so as to reset data of the pixel circuit and have an voltage compensation effect on the pixel circuit; and enabling the gate signal so as to operate the pixel circuit in a data writing period, and supplying, in the data writing period, a data voltage to the pixel circuit so as to change a terminal voltage of a driving transistor, which is used to drive the light-emitting device.

In summary, the disclosure provides a pixel circuit, which is implemented with five transistors and two capacitors, and a driving method thereof. While being applied to an AMOLED, the pixel circuit according to the present disclosure is capable of receiving a data voltage in an entire data writing period; and thus, a high frame rate driving technology is realized.

BRIEF DESCRIPTION OF THE DRAWINGS

The present disclosure will become more readily apparent to those ordinarily skilled in the art after reviewing the following detailed description and accompanying drawings, in which.

DETAILED DESCRIPTION OF PREFERRED EMBODIMENTS

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Organic Light Emitting Diode (OLED) lightness thereof is determined by a current flowing there through. For an Active Matrix OLED (AMOLED), the current flowing through the OLED is controlled by a driving Thin Film Transistor (TFT). Therefore, any factor associated with the TFT or OLED accordingly will affect the display quality of the AMOLED.

Therefore, the present disclosure provides a pixel circuit and a driving method thereof capable of preventing the above-mentioned problems.

Figure 1:
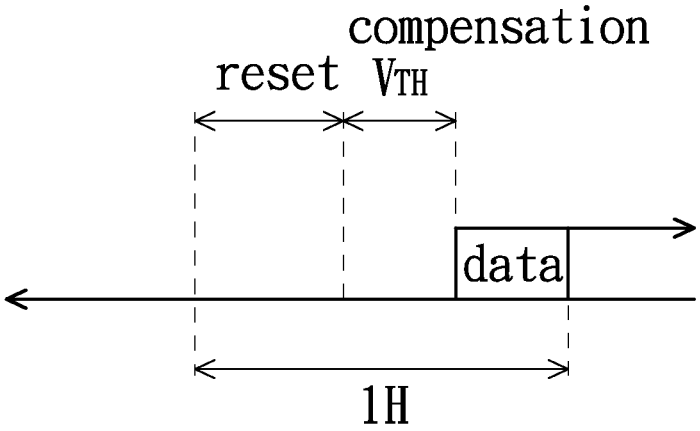
FIG. 1 (Prior Art)
FIG. 1 is a schematic waveform chart illustrating the required time for a pixel circuit receiving a data voltage while being operated in a data writing period.
Figure 2A:
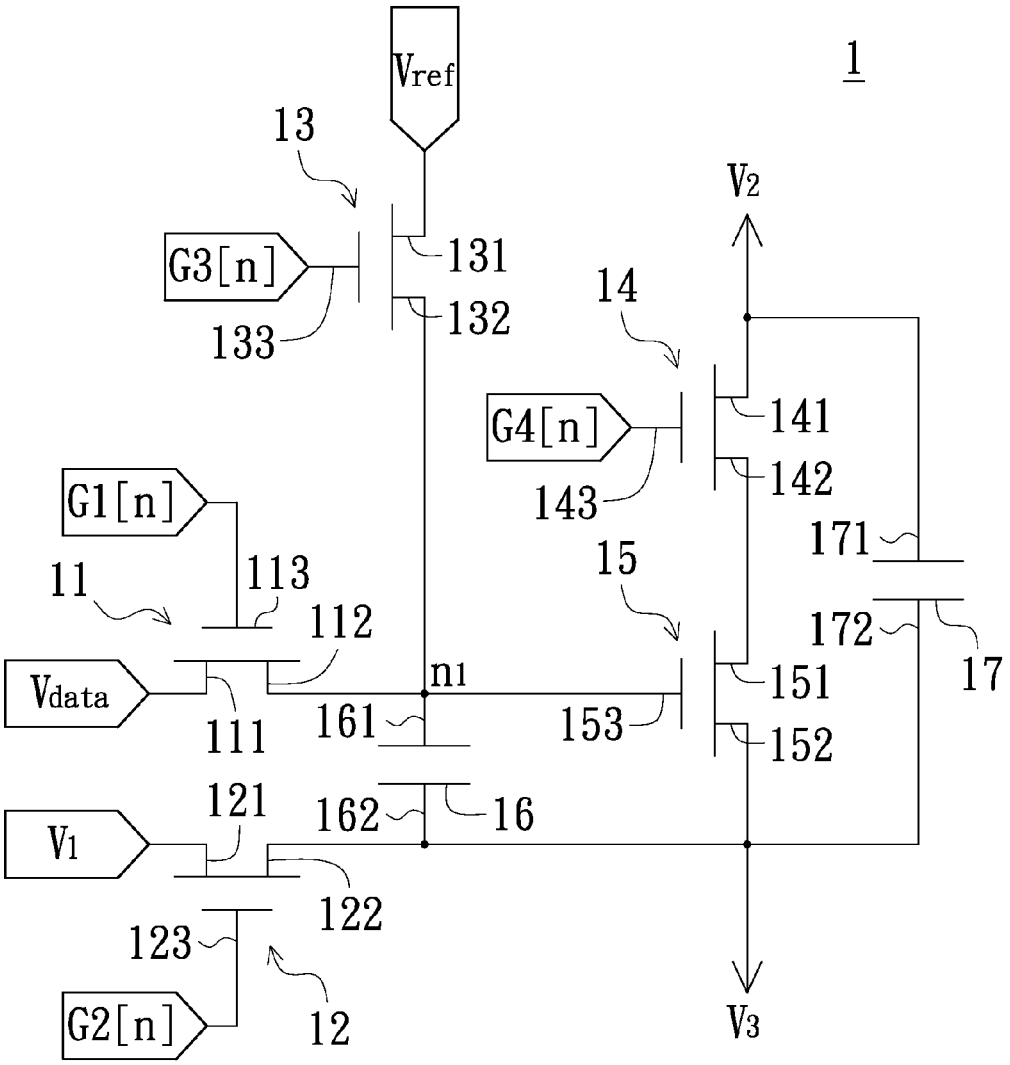
FIG. 2A is a schematic circuit view of a pixel circuit in accordance with an embodiment of the present disclosure.

FIG. 2A is a schematic circuit view of a pixel circuit in accordance with an embodiment of the present disclosure. As shown, the pixel circuit 1 includes a first switch 11, a second switch 12, a third switch 13, a fourth switch 14, a driving transistor 15, a first capacitor 16 and a second capacitor 17; wherein the switches 11~14 each have a first terminal, a second terminal and a control terminal configured to control turn-on or turn off between the first and second terminals. Following is a detailed description of the connecting relationship of the terminals in the pixel circuit 1.

The first terminal 111 of the first switch 11 is configured to receive a data voltage $V_{data}$. The second terminal 112 of the first switch 11, the second terminal 132 of the third switch 13, one terminal 161 of the first capacitor 16 and the control terminal 153 of the driving transistor 15 are configured to be electrically connected to a first connecting node n1. The first terminal 121 of the second switch 12 is configured to receive a first power voltage $V_1$. The first terminal 131 of the third switch 13 is configured to receive a reference voltage $V_{ref}$. The first terminal 141 of the fourth switch 14 and one terminal 171 of the second capacitor 17 are configured to be electrically connected to a second power voltage $V_2$. The second terminal 142 of the fourth switch 14 and the first terminal 151 of the driving transistor 15 are configured to be electrically connected to each other. The second terminal 122 of the second switch 12, another terminal 162 of the first capacitor 16, the second terminal 152 of the driving transistor 15 and anther terminal 172 of the second capacitor 17 are configured to be electrically connected a third power voltage $V_3$.

Figure 2B:
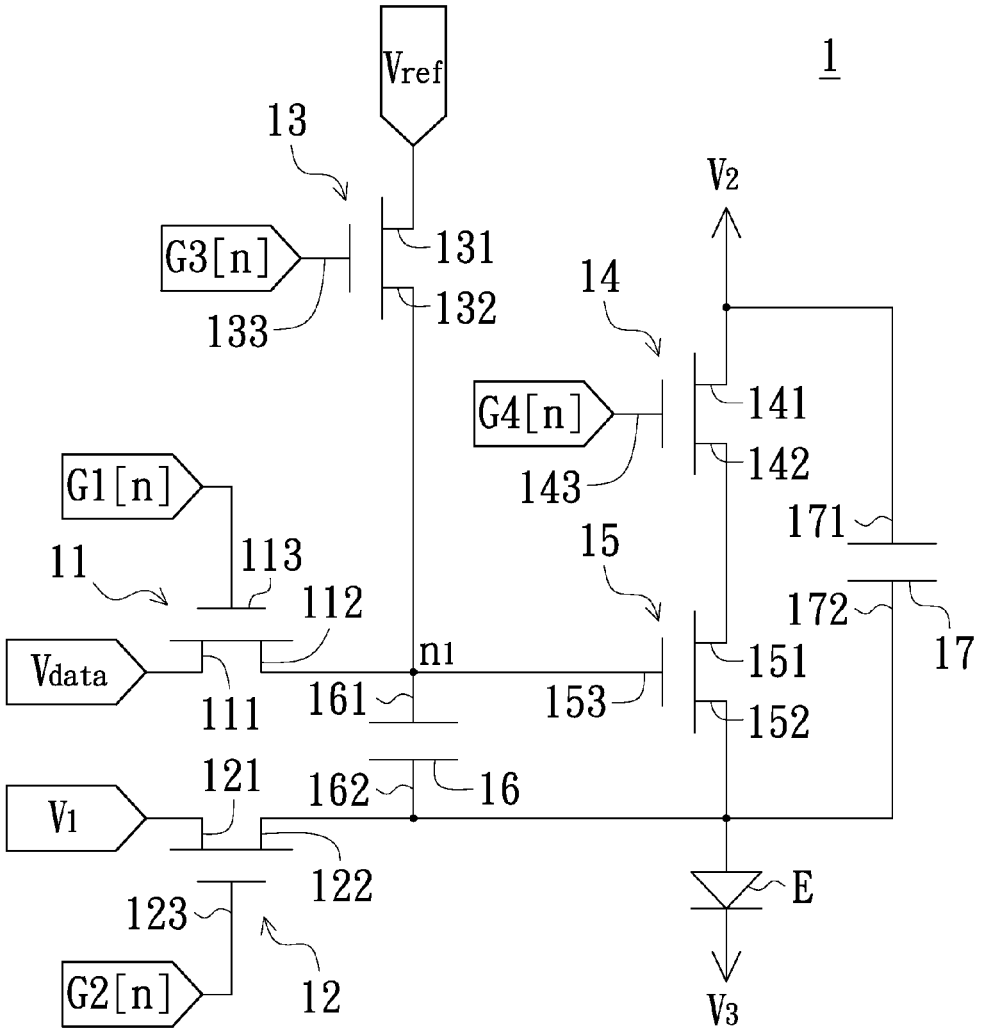
FIG. 2B is a schematic circuit view illustrating that the pixel circuit of the present disclosure is configured to drive an OLED.

FIG. 2B is a schematic circuit view illustrating that the pixel circuit 1 is configured to drive an emitting device (for example, an OLED and designated by E). As shown, the OLED E is configured to have its anode terminal electrically connected to the second terminal 122 of the second switch 12, the terminal 162 of the first capacitor 16, the terminal 172 of the second capacitor 17 and the second terminal 152 of the driving transistor 15 and its cathode terminal electrically connected to the third power voltage $V_3$.

In the pixel circuit 1 according to a preferred embodiment, the switches 11, 12, 13 and 14 each are implemented with a p-type TFT; alternatively, the switches 11, 12, 13 and 14 each are implemented with a n-type TFT, as well as the driving transistor 15 is. In addition, the power voltage $V_1$, $V_2$ and $V_3$ are configured to have different values.

It is understood that, the configurations for turn-on or turn-off of each switches 11~14 (implemented with either an n-type or a p-type TFT) and the driving transistor (implemented with an n-type TFT) are apparent to those ordinarily skilled in the art, there will be no any unnecessary detail given herein.

Figure 3:
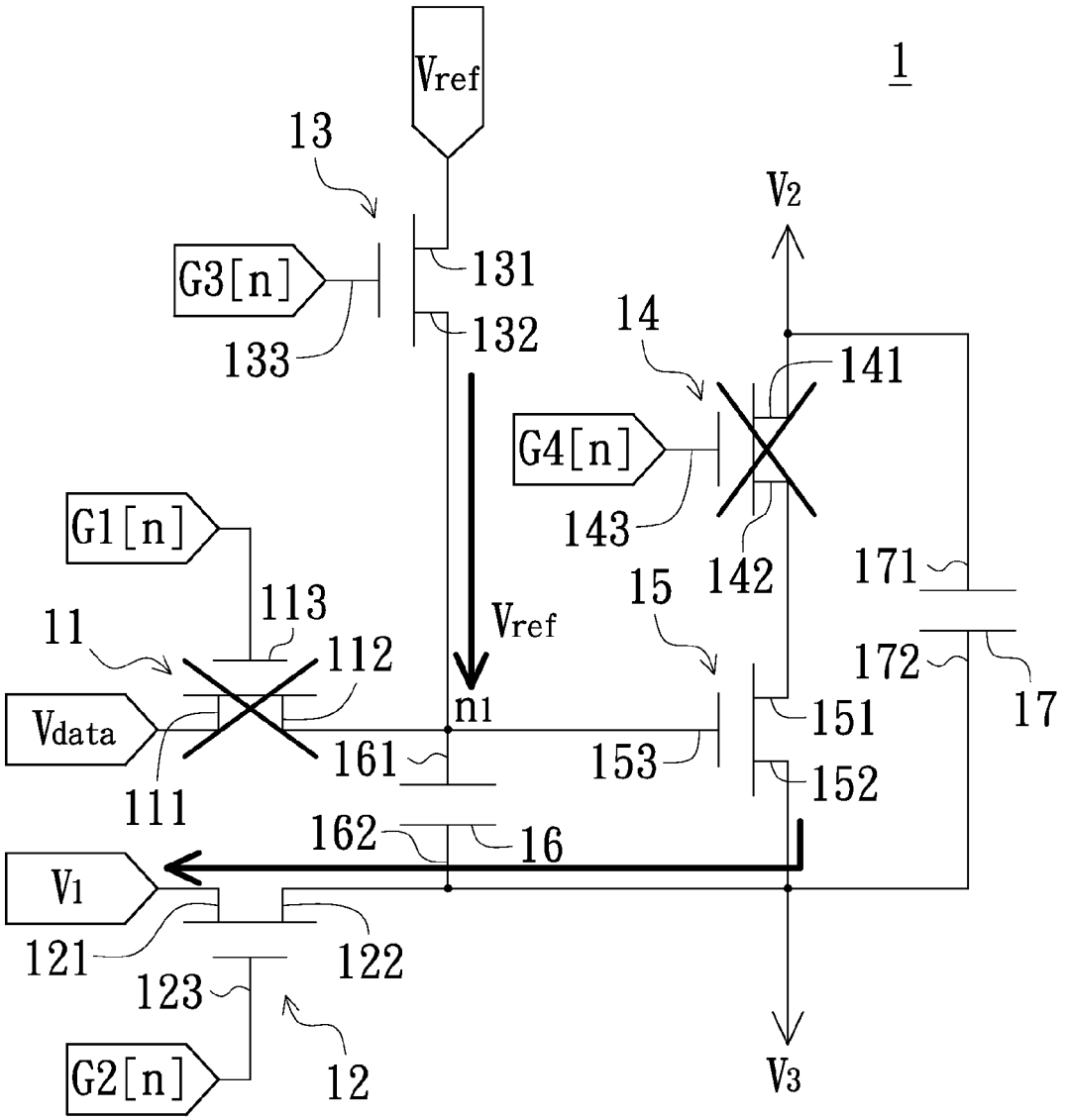
FIG. 3 is a view illustrating a circuit state of the pixel circuit of the present disclosure while being configured in a reset period.

Based on the circuit structure of the pixel circuit 1, the disclosure further provides a driving method for configuring turn-on or turn-off of the switches 11~14 and the driving transistor 15. Please refer to FIGS. 3, 4. FIG. 3 is a view illustrating a circuit state of the pixel circuit 1 while the pixel circuit 1 is configured in a reset period and FIG. 4 is a corresponding timing diagram of the control signals associated with the pixel circuit 1 in the reset period.

Figure 4:
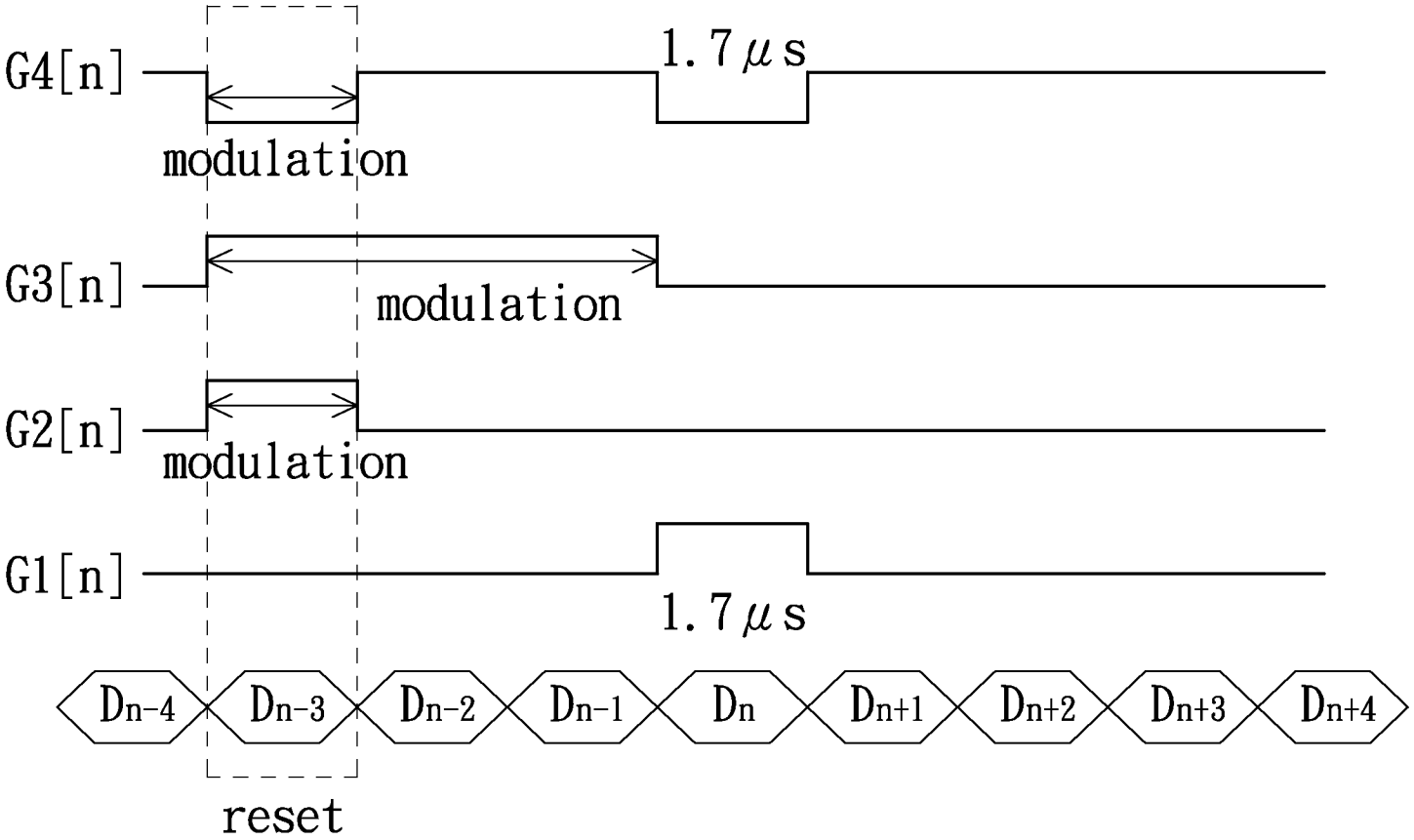
FIG. 4 is a timing diagram of the control signals associated with the pixel circuit of the present disclosure operated in the reset period.

In the sequence period $[D_{n-3}]$ as illustrated in FIG. 4, a logic-low first control G1[n] is configured to be supplied to the control terminal 113 of the first switch 11 and a logic-low fourth control G4[n] is configured to be supplied to the control terminal 143 of the fourth switch 14 so as to turn off the first switch 11 and the fourth switch 14, respectively; and, a logic-high second control G2[n] is configured to be supplied to the control terminal 123 of the second switch 12 and a logic-high third control G3[n] is configured to be supplied to the control terminal 133 of the third switch 13 so as to turn on the second switch 12 and the third switch 13, respectively. Based on the above configuration, the reference voltage $V_{ref}$ is supplied to the control terminal 153 (for example, a gate terminal) of the driving transistor 15 (for example, a n-type TFT) via the turned-on third switch 13 and the second terminal 152 (for example, a source terminal) of the driving transistor 15 is configured to be set at the third power voltage of $V_3$. And thus, the pixel circuit 1, in the sequence period $[D_{n-3}]$, is configured to be in a reset period and will not be affected by a prior display while the pixel circuit 1 is configured to perform a compensation operation in a next phase.

Figure 5:
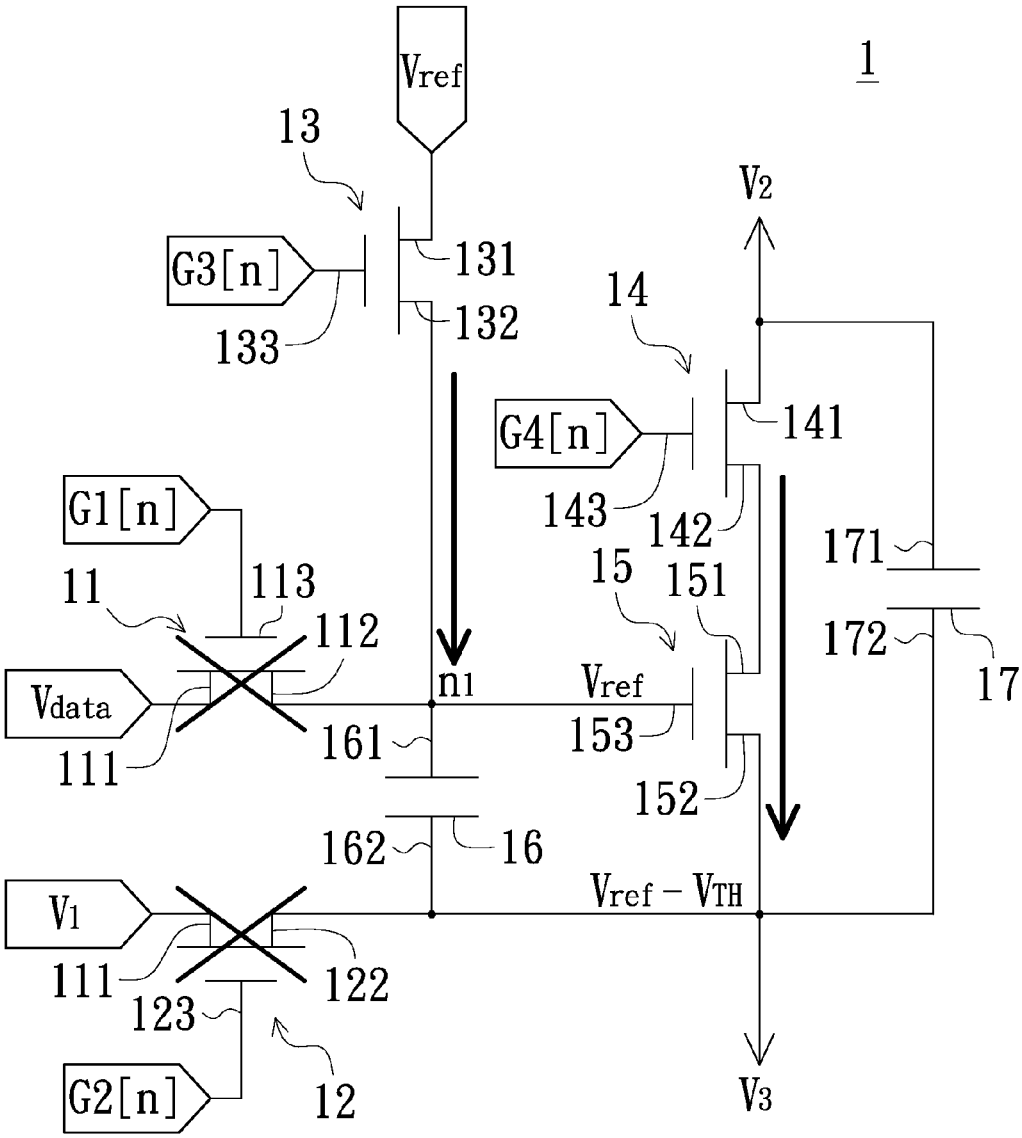
FIG. 5 is a view illustrating a circuit state of the pixel circuit of the present disclosure while being configured in a compensation period.
Figure 6:
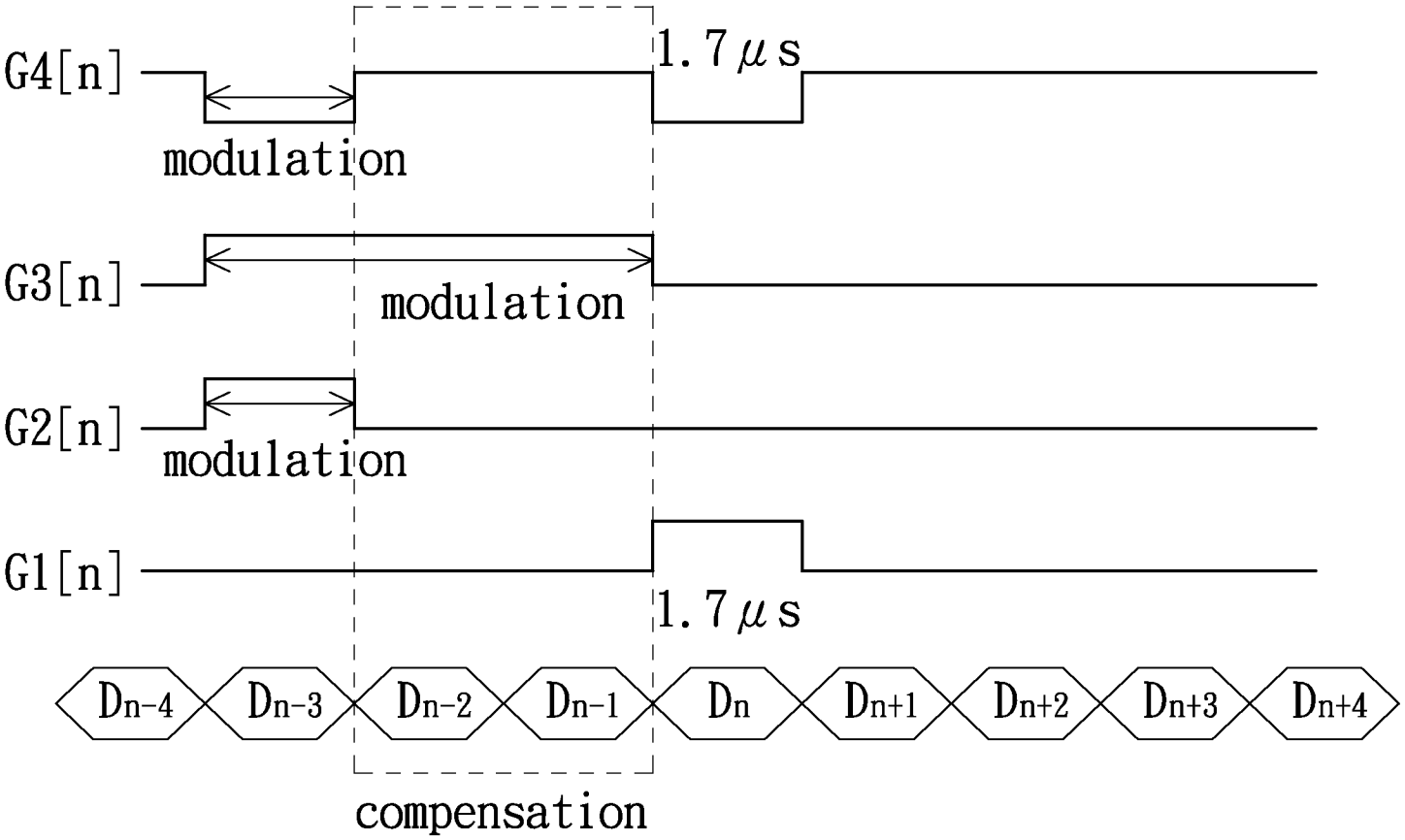
FIG. 6 is a timing diagram of the control signals associated with the pixel circuit of the present disclosure operated in the compensation period.

Please refer to FIGS. 5, 6. FIG. 5 is a view illustrating a circuit state of the pixel circuit 1 while the pixel circuit 1 is configured in a compensation period, which is following to the reset period; and FIG. 6 is a corresponding timing diagram of the control signals associated with the pixel circuit 1 in the compensation period.

In the sequence periods $[D_{n-2}]$~$[D_{n-1}]$ as illustrated in FIG. 6, a logic-low first control G1[n] is configured to be supplied to the control terminal 113 of the first switch 11 and a logic-low second control G2[n] is configured to be supplied to the control terminal 123 of the second switch 12 so as to turn off the first switch 11 and the second switch 12, respectively; and, a logic-high third control G3[n] is configured to be supplied to the control terminal 133 of the third switch 13 and a logic-high fourth control G4[n] is configured to be supplied to the control terminal 143 of the fourth switch 13 so as to turn on the third switch 13 and the fourth switch 14, respectively. Based on the above configuration, the second power voltage $V_2$ is supplied to the first terminal 151 of the driving transistor 15 via the turned-on fourth switch 14; and the second terminal 152 (for example, a source terminal and initially is configured to be set at $V_3$) of the driving transistor 15 is charged by the second power voltage $V_2$ via the second capacitor 17, until a differential voltage between the control terminal 153 (configured to be set at $V_{ref}$) and the second terminal 152 is equal to the threshold voltage ($V_{TH}$) of the driving transistor 15 thereby by causing cut-off of the driving transistor 15. In addition, in this sequence period the first capacitor 16 is configured to store the $V_{TH}$ of the driving transistor 15. And thus, the pixel circuit 1 is configured to be in the compensation period.

Figure 7:
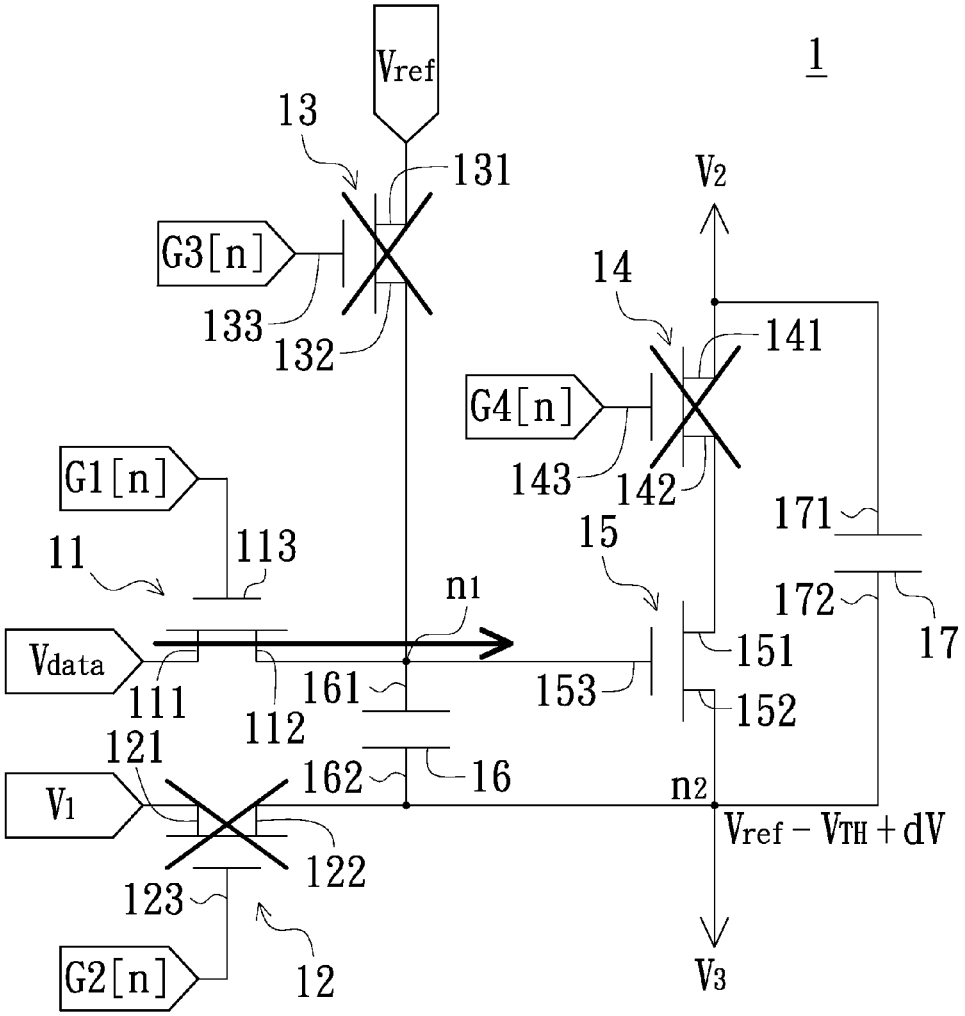
FIG. 7 is a view illustrating a circuit state of the pixel circuit of the present disclosure while being configured in a data writing period.
Figure 8:
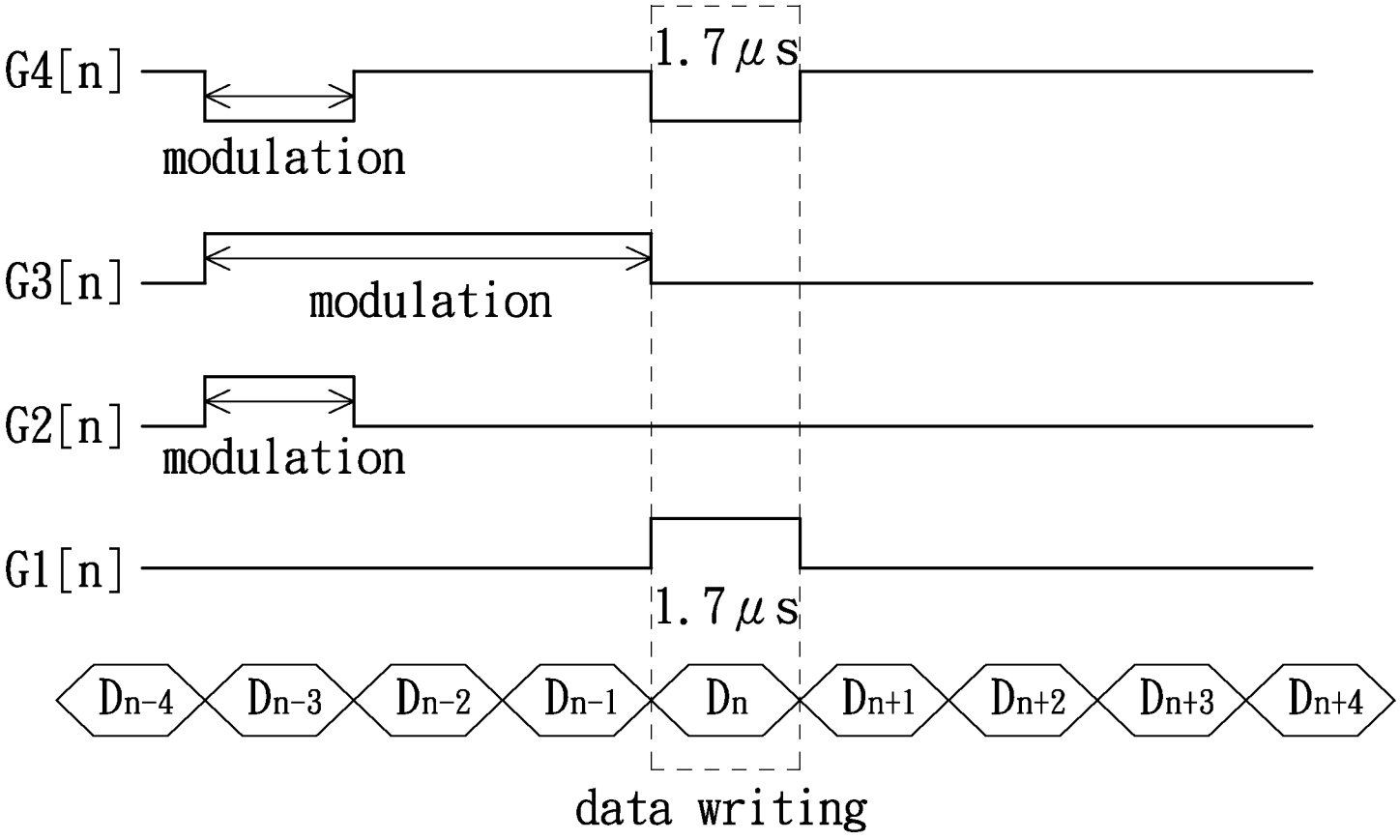
FIG. 8 is a timing diagram of the control signals associated with the pixel circuit of the present disclosure operated in the data writing period.

Please refer to FIGS. 7, 8. FIG. 7 is a view illustrating a circuit state of the pixel circuit 1 while the pixel circuit 1 is configured in a data writing period, which is following to the compensation period; and FIG. 8 is a corresponding timing diagram of the control signals associated with the pixel circuit 1 in the data writing period.

In the sequence period [$D_n$] as illustrated in FIG. 8, a logic-high first control G1[n] is configured to be supplied to the control terminal 113 of the first switch 11 so as to turn on the first switch 11; and, a logic-low second control G2[n] is configured to be supplied to the control terminal 123 of the second switch 12, a logic-low third control G3[n] is configured to be supplied to the control terminal 133 of the third switch 13 and a logic-low fourth control G4[n] is configured to be supplied to the control terminal 143 of the fourth switch 14 so as to turn off the second switch 12, the third switch 13 and the fourth switch 14, respectively. Based on the above configuration, the data voltage $V_{data}$ is supplied to the control terminal 153 (for example, a gate terminal) of the driving transistor 15 via the turned-on first switch 11 and thereby converting the voltage at the control terminal 153 of the driving transistor 15 from $V_{ref}$ into $V_{data}$. In other words, the pixel circuit 1, in the entire data writing period, is configured to receive the data voltage $V_{data}$ via the control terminal 153 of the driving transistor 15.

In particular, it is to be noted that the terminal 162 of the first capacitor 16, the terminal 172 of the second capacitor 17 and the second terminal 152 (for example, a source terminal) of the driving transistor 15 are configured to be electrically connected to a second connecting node n2 and thereby each being configured to be set at a voltage of $V_{ref}-V_{TH}+dV$; wherein dV is $$\frac{C1}{C1+C2}(V_{data}-V_{ref}),$$

C1 is a capacitance value of the first capacitor 16 and C2 is a capacitance value of the second capacitor 16.

Figure 9:
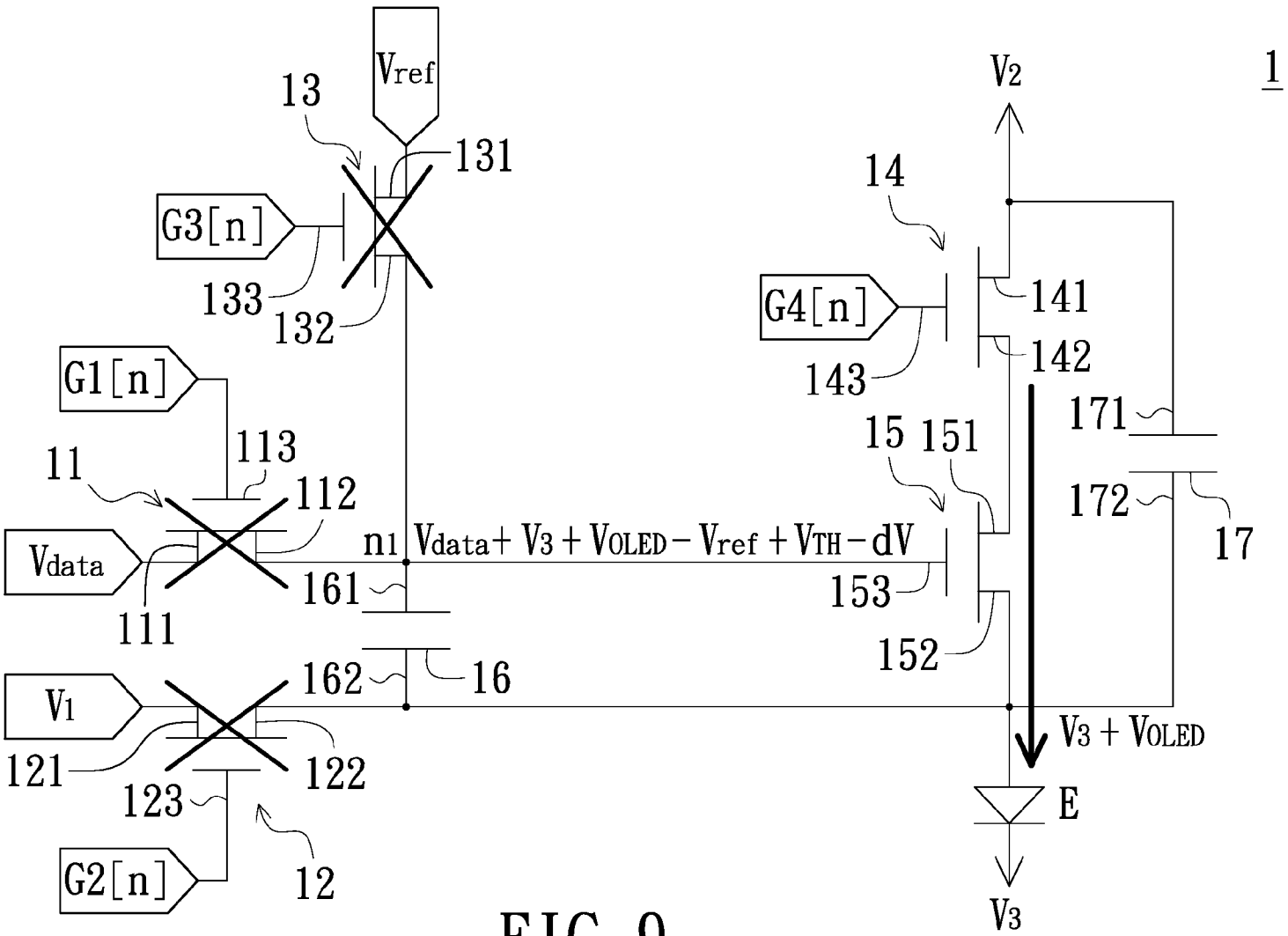
FIG. 9 is a view illustrating a circuit state of the pixel circuit of the present disclosure configuring an OLED to emit lights.
Figure 10:
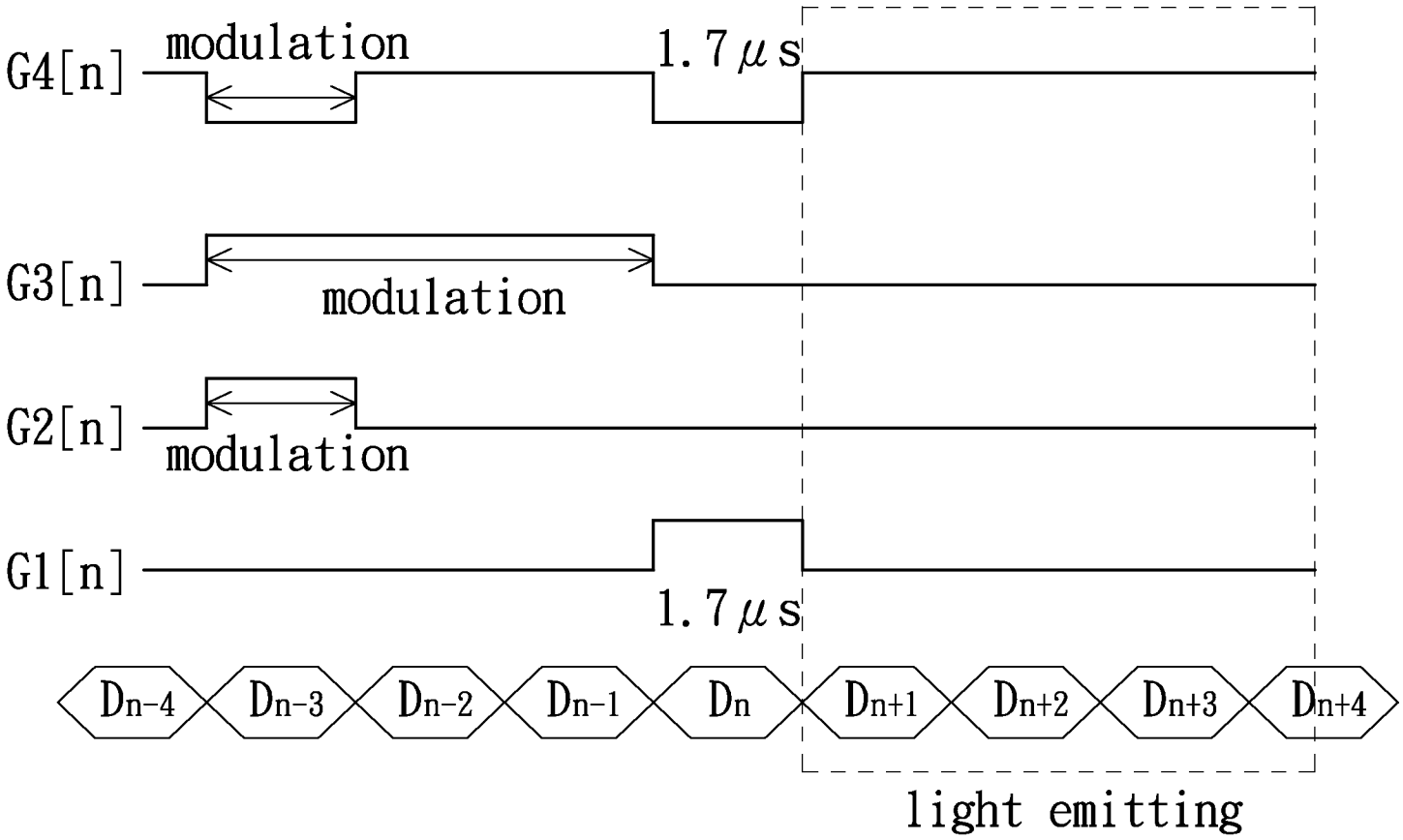
FIG. 10 is timing diagram of the control signals associated with the pixel circuit of the present disclosure configuring an OLED to emit lights.

Please refer to FIGS. 9, 10. FIG. 9 is a view illustrating a circuit state of the pixel circuit 1 configuring an OLED to emit lights; and FIG. 10 is a corresponding timing diagram of the control signals associated with the pixel circuit 1 configuring an OLED to emit lights.

In the sequence periods [$D_{n+1}$]~[$D_{n+4}$] as illustrated in FIG. 10, a logic-low first control G1[n] is configured to be supplied to the control terminal 113 of the first switch 11, a logic-low second control G2[n] is configured to be supplied to the control terminal 123 of the second switch 12 and a logic-low third control G3[n] is configured to be supplied to the control terminal 133 of the third switch 13 so as to turn off the first switch 11, the second switch 12 and the third switch 13, respectively; and, a logic-high fourth control G4[n] is configured to be supplied to the control terminal 143 of the fourth switch 14 so as to turn on the fourth switch 14. Based on the above configuration, the control terminal 153 (for example, a gate terminal) of the driving transistor 15 is configured to be in a floating state and set to a voltage of: $V_{G=Vdata}+V_3+V_{OLED}-V_{ref}+V_{TH}-dV$; wherein $V_{OLED}$ is the crossing voltage between the two terminals of the OLED E. In addition, the second terminal 152 (for example, a source terminal) of the driving transistor 15 is configured to be set to a voltage of: $V_S=V_3+V_{OLED}$. And thus, the current $I_{OLED}$ flowing through the OLED E can be obtained according to the equation 1:

$$I_{OLED}=K(V_{GS}-V_{TH})^2=K(V_{data}+V_3+V_{OLED}-V_{ref}+V_{TH}-dV-V_3-V_{OLED}-V_{TH})^2=K(V_{data}-V_{ref}-dV)^2 \quad \text{equation 1}$$

As shown in equation 1, the current $I_{OLED}$ obtained in the present disclosure is not related to the $V_{TH}$ of the driving transistor 15. In addition, the pixel circuit 1 can have a larger current $I_{OLED}$ when, due to the OLED has been used for a long time, an increasing crossing voltage and a decreasing light-emitting efficiency occur; and thus, the low light-emitting efficiency is compensated.

Based on the driving process of the pixel circuit 1 described above, the present disclosure further provides a driving method of a pixel circuit; wherein the pixel circuit is configured to drive a light-emitting device (for example, an OLED). In addition, the description of the driving method of a pixel circuit basically is based on the timing diagram, as illustrated in FIG. 4, of the associated control signals configuring the pixel circuit 1 to be in the reset period, the timing diagram, as illustrated in FIG. 6, of the associated control signals configuring the pixel circuit 1 to be in the compensation period and the timing diagram, as illustrated in FIG. 8, of the associated control signals configuring the pixel circuit 1 to be in the data writing period.

Initially, a plurality of control signals and a gate signal G1[n] are supplied to the pixel circuit 1; wherein the control signals includes at least the first control signal G2[n], the second control signal G3 [n] and the third control signal G4[n].

Next, as illustrated in FIG. 4 and in the sequence period [$D_{n-3}$], the operation states (either enable or disable) of the first control signal G2[n], the second control signal G3[n] and the third control signal G4[n] are modulated and the gate signal G1[n] is configured to be kept being disable so as to operate the pixel circuit to be in a reset period. Specifically, the first control signal G2[n] and the second control signal G3[n] are enable if each have a logic-high voltage thereon; and the third control signal G4[n] and the gate signal G1[n] are disable if each have a logic-low voltage thereon.

As illustrated in FIG. 6 and in the sequence periods [$D_{n-2}$]~[$D_{n-1}$], the first control signal G2[n] is configured to be disable by a logic-low voltage thereon and the gate signal G1[n] is configured to be kept being disable by a logic-low voltage thereon; and, the second control signal G3[n] and the third control signal G4[n] are configured to be enable by a logic-high voltage thereon. Thus, the pixel circuit 1 is operated in the compensation period.

As illustrated in FIG. 8 and in the sequence period [$D_n$], the first control signal G2[n], the second control signal G3[n] and the third control signal G4[n] are configured to be disable by a logic-low voltage thereon; and, the gate terminal G1[n] is configured to be enable by a logic-high voltage thereon. Thus, the pixel circuit 1 is configured in a data writing period. In addition, the data voltage $V_{data}$ is configured to, in the data writing period, supply to the pixel circuit 1 so as to modulate the voltage at the a terminal of the driving transistor 15, which is for driving a lighting element.

Figure 11:
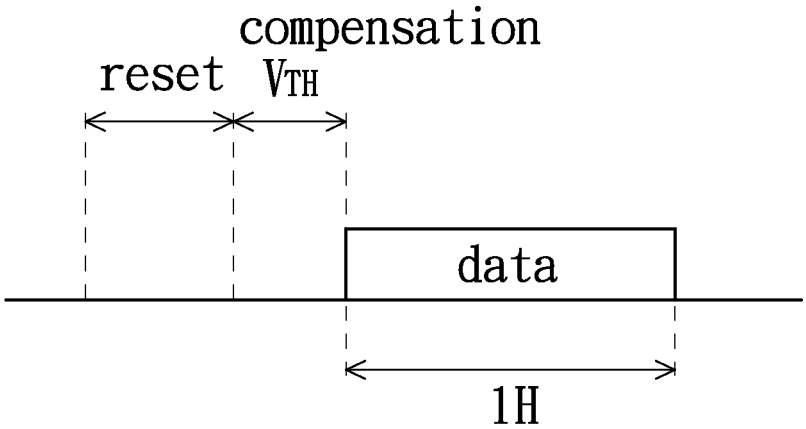
FIG. 11 is a schematic waveform chart illustrating the required time for a pixel circuit of the present disclosure receiving a data voltage while being operated in a data writing period.

In summary, the disclosure provides a pixel circuit, which is implemented with five transistors and two capacitors, and a driving method thereof. While being applied to an AMOLED, the pixel circuit according to the present disclosure is capable of, as illustrated in FIG. 11, receiving a data voltage in an entire data writing period; and thus, a high frame rate driving technology is realized.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A driving method, for a pixel circuit, the driving method comprising:

supplying, when the pixel circuit is operated in a data writing period, a first control signal to the control terminal of a first switch so as to turn on the first switch and supplying the first control signal to turn off the first switch when the pixel circuit is not in the data writing period; and supplying a second, a third and a fourth control signals to the control terminals of a second, third and fourth switches, respectively, so as to turn off the second, third and fourth switches at the same time in the entire data writing period and thereby configuring the control terminal of a driving transistor to receive the data voltage in the entire data writing period;

wherein the pixel circuit comprising the first switch, the second switch, the third switch, the fourth switch, and the driving transistor, wherein the switches and the driving transistor each have a first terminal, a second terminal and a control terminal configured to control turn-on or turn-off between its associated first and second terminals; the first terminal of the first switch is configured to receive a data voltage; the second terminal of the first switch, the second terminal of the third switch and the control terminal of the driving transistor are configured to be electrically coupled to a first connecting node; the first terminal of the second switch is configured to receive a first power voltage; the first terminal of the fourth switch is configured to receive a second power voltage; the first terminal of the third switch is configured to receive a third power voltage; the second terminal of the fourth switch and the first terminal of the driving transistor are configured to be electrically coupled to each other; the second terminal of the second switch and the second terminal of the driving transistor are configured to be electrically coupled to each other;

a first capacitor, wherein one terminal of the first capacitor is configured to be electrically coupled to the first connecting node;

a second capacitor, wherein one terminal of the second capacitor is configured to receive the second power voltage; another terminal of the first capacitor, the second terminal of the driving transistor and another terminal of the second capacitor are configured to be electrically coupled together;

the second terminal of the first switch, the second terminal of the third switch and the control terminal of the driving transistor are configured to directly connect to a first connecting node.

2. The driving method according to claim 1, wherein the data writing period is an entire period of a horizontal line.

3. The driving method according to claim 2, wherein the driving method before the pixel circuit being operated in a data writing period, further comprises:

supplying the first and fourth control signals to the controls terminals of the first and fourth switches, respectively, so as to turn off the first and fourth switches; and supplying the second and third control signals to the control terminals of the second and third switches, respectively, so as to turn on the second and third switches and thereby operating the pixel in a reset period.

4. The driving method according to claim 3, wherein the reset period is at least a period of a horizontal line.

5. The driving method according to claim 3, wherein the driving method after the pixel circuit being operated in the reset period and before operated in the data writing period, further comprises:

supplying the first and second control signals to the controls terminals of the first and second switches, respectively, so as to turn off the first and second switches; and supplying the third and fourth control signals to the control terminals of the third and fourth switches, respectively, so as to turn on the third and fourth switches and thereby operating the pixel in a compensation period.

6. The driving method according to claim 5, wherein the compensation period is at least a period of a horizontal line.

7. A driving method of a pixel circuit adapted to be used to drive a light-emitting device, the driving method comprising:

supplying a plurality of control signals and a gate signal to the pixel circuit;

modulating an operation state of each control signals and keeping the gate signal being disable so as to reset data of the pixel circuit and have a voltage compensation effect on the pixel circuit; and enabling the gate signal so as to operate the pixel circuit in a data writing period, and supplying, in the entire data writing period, a data voltage to the pixel circuit so as to change a terminal voltage of a driving transistor, which is used to drive the light-emitting device wherein, the gate signal are disabled when the pixel circuit is not in the data writing period;

supplying a second, a third and a fourth control signals to the control terminals of a second, third and fourth switches, respectively, so as to turn off a second, third and fourth switches at the same time in the entire data writing period and thereby configuring the control terminal of a driving transistor to receive the data voltage in the entire data writing period;

wherein the pixel circuit comprising a first switch, the second switch, the third switch, the fourth switch, and the driving transistor, wherein the switches and the driving transistor each have a first terminal, a second terminal and a control terminal configured to control turn-on or turn-off between its associated first and second terminals; the first terminal of the first switch is configured to receive a data voltage; the second terminal of the first switch, the second terminal of the third switch and the control terminal of the driving transistor are configured to be electrically coupled to a first connecting node; the first terminal of the second switch is configured to receive a first power voltage; the first terminal of the fourth switch is configured to receive a second power voltage; the first terminal of the third switch is configured to receive a third power voltage; the second terminal of the fourth switch and the first terminal of the driving transistor are configured to be electrically coupled to each other; the second terminal of the second switch and the second terminal of the driving transistor are configured to be electrically coupled to each other;

a first capacitor, wherein one terminal of the first capacitor is configured to be electrically coupled to the first connecting node;

a second capacitor, wherein one terminal of the second capacitor is configured to receive the second power voltage; another terminal of the first capacitor, the second terminal of the driving transistor and another terminal of the second capacitor are configured to be electrically coupled together;

the second terminal of the first switch, the second terminal of the third switch and the control terminal of the driving transistor are configured to directly connect to a first connecting node.

8. The driving method according to claim 7, wherein the data writing period is an entire period of a horizontal line.

9. The driving method according to claim 7, wherein the control signals comprise a first, a second and a third control signals, the first, second and third control signals are configured to be enable if each is in a logic-low state, and the gate signal is configured to be enable if it is in a logic-high state.

10. The driving method according to claim 7, wherein the control signals comprise a first, a second and a third control signals, the first, second and third control signals are configured to be enable if each is in a logic-high state, and the gate signal is configured to be enable if it is in a logic-high state.

11. The driving method according to claim 7, wherein the step of modulating an operation state of each control signals and keeping the gate signal being disable so as to reset data of the pixel circuit and have a voltage compensation effect on the pixel circuit comprises:

after a first, a second and a third control signals and the gate signal being supplied to the pixel circuit, configuring the first and second control signals to be enable and configuring the third control signal and the gate signal to be disable so as to operate the pixel circuit in a reset period.

12. The driving method according to claim 11, wherein the reset period is at least a period of a horizontal line.

13. The driving method according to claim 11, wherein the step of modulating an operation state of each control signals and keeping the gate signal being disable so as to reset data of the pixel circuit and have a voltage compensation effect on the pixel circuit comprises:

between the reset period and the data writing period, configuring the first control signal and the gate signal to be disable and configuring the second and third control signals to be enable so as to operate the pixel circuit in a compensation period.

14. The driving method according to claim 7, wherein the step of modulating an operation state of each control signals and keeping the gate signal being disable so as to reset data of the pixel circuit and have a voltage compensation effect on the pixel circuit comprises:

after a first, a second and a third control signals and the gate signal being supplied to the pixel circuit, configuring the first and second control signals to be enable and configuring the third control signal and the gate signal to be disable so as to operate the pixel circuit in a reset period.

15. The driving method according to claim 14, wherein the step of modulating an operation state of each control signals and keeping the gate signal being disable so as to reset data of the pixel circuit and have an voltage compensation effect on the pixel circuit comprises:

between the reset period and the data writing period, configuring the first control signal and the gate signal to be disable and configuring the second and third control signals to be enable so as to operate the pixel circuit in a compensation period.

* * * * *